US012071946B2

(12) United States Patent
Simmons et al.

(10) Patent No.: US 12,071,946 B2
(45) Date of Patent: Aug. 27, 2024

(54) FLUID PUMP WITH DUAL PLUNGERS AND RELATED SYSTEMS AND METHODS

(71) Applicant: White Knight Fluid Handling Inc., Kamas, UT (US)

(72) Inventors: Tom Simmons, Kamas, UT (US); Courtney Parsons, Taylorsville, UT (US)

(73) Assignee: White Knight Fluid Handling Inc., Kamas, UT (US)

( * ) Notice: Subject to any disclaimer, the term of this patent is extended or adjusted under 35 U.S.C. 154(b) by 462 days.

(21) Appl. No.: 17/146,807

(22) Filed: Jan. 12, 2021

(65) Prior Publication Data

US 2021/0131418 A1 May 6, 2021

Related U.S. Application Data

(63) Continuation of application No. 16/011,015, filed on Jun. 18, 2018, now Pat. No. 10,890,172.

(51) Int. Cl.
*F04B 5/02* (2006.01)
*F04B 9/133* (2006.01)
(Continued)

(52) U.S. Cl.
CPC ..... *F04B 5/02* (2013.01); *F04B 9/133* (2013.01); *F04B 43/0054* (2013.01);
(Continued)

(58) Field of Classification Search
CPC .. F04B 43/025; F04B 43/0733; F04B 43/086; F04B 45/02; F04B 45/024; F04B 45/022; F04B 53/1002; F04B 2201/0201
See application file for complete search history.

(56) References Cited

U.S. PATENT DOCUMENTS 2,464,095 A 3/1949 Nies
2,578,265 A 12/1951 Royal
(Continued)

FOREIGN PATENT DOCUMENTS

CN 102720649 A 10/2012
JP 6008485 A 1/1985
(Continued)

OTHER PUBLICATIONS

Chinese First Office Action for Chinese Application No. 201910526402.8, dated Jun. 23, 2022, 8 pages with 1 translation.
(Continued)

*Primary Examiner* — Nathan C Zollinger
(74) *Attorney, Agent, or Firm* — TraskBritt

(57) ABSTRACT

A reciprocating fluid pump includes a pump body, a subject fluid chamber, a first plunger located within the subject fluid chamber of the pump body and having a first head portion and a first bellows, the first plunger configured to expand and compress in a reciprocating action to pump the subject fluid through the subject fluid chamber within the pump body, wherein the first head portion and the first bellows have a first cross-sectional dimension, and a second plunger located within the subject fluid chamber of the pump body and having a second head portion and a second bellows, the second plunger configured to expand and compress in a reciprocating action to pump the subject fluid through the subject fluid chamber within the pump body, wherein the second head portion and the second bellows have a second cross-sectional dimension that is smaller than the first cross-sectional dimension.

19 Claims, 4 Drawing Sheets

(51) Int. Cl.

| | |
|---|---|
| ***F04B 43/00*** | (2006.01) |
| ***F04B 43/08*** | (2006.01) |
| ***F04B 43/10*** | (2006.01) |
| ***F04B 43/113*** | (2006.01) |
| ***F04B 45/02*** | (2006.01) |

(52) U.S. Cl.
CPC ..... *F04B 43/084* (2013.01); *F04B 45/02* (2013.01); *F04B 43/10* (2013.01); *F04B 43/113* (2013.01); *F04B 2201/0201* (2013.01)

(56) References Cited

U.S. PATENT DOCUMENTS

| | | | | |
|---|---|---|---|---|
| 2,613,607 | A | 10/1952 | Sheen et al. | |
| 2,613,610 | A * | 10/1952 | Royal | F04B 43/086 417/313 |
| 2,951,450 | A | 9/1960 | Fisher | |
| 5,141,412 | A | 8/1992 | Meinz | |
| 5,224,841 | A | 7/1993 | Thompson et al. | |
| 5,480,292 | A * | 1/1996 | Chevallier | F04B 43/1136 417/393 |
| 5,558,506 | A | 9/1996 | Simmons et al. | |
| 5,863,186 | A * | 1/1999 | Green | F04B 9/113 417/244 |
| 6,079,959 | A * | 6/2000 | Kingsford | F04B 53/164 417/393 |
| 6,183,223 | B1 | 2/2001 | Yajima | |
| 6,814,553 | B2 | 11/2004 | Watanabe et al. | |
| 8,087,910 | B2 | 1/2012 | Yajima | |
| 8,622,720 | B2 | 1/2014 | Simmons et al. | |
| 8,636,484 | B2 | 1/2014 | Simmons et al. | |
| 8,672,645 | B2 * | 3/2014 | Lin | F16K 11/07 137/625.69 |
| 8,997,630 | B2 * | 4/2015 | Heurich | F15B 15/2861 92/5 R |
| 9,518,577 | B2 | 12/2016 | Van et al. | |
| 10,890,172 | B2 * | 1/2021 | Simmons | F04B 43/084 |
| 2004/0146415 | A1 | 7/2004 | Merrill et al. | |
| 2009/0324431 | A1 | 12/2009 | Van et al. | |
| 2010/0119392 | A1 | 5/2010 | Masuda et al. | |
| 2010/0282991 | A1 | 11/2010 | Okamoto | |
| 2013/0343934 | A1 * | 12/2013 | Du | F04B 3/00 417/523 |
| 2014/0334957 | A1 | 11/2014 | Simmons et al. | |
| 2017/0191476 | A1 | 7/2017 | Matsuda et al. | |
| 2018/0087181 | A1 | 3/2018 | Wang et al. | |
| 2020/0011322 | A1 | 1/2020 | Mori et al. | |

FOREIGN PATENT DOCUMENTS

| | | | |
|---|---|---|---|
| JP | 2016-037912 | A | 3/2016 |
| TW | 550632 | B | 9/2003 |
| TW | 200417418 | A | 9/2004 |

OTHER PUBLICATIONS

Japanese Notice of Reasons for Refusal for Japanese Application No. 2019-111972, dated Mar. 15, 2023, 6 pages with English translation.

Japanese Search Report for Japanese Application No. 2019-111972, dated Mar. 15, 2023, 16 pages with English translation.

Taiwanese Search Report and Office Action from Taiwanese Application No. 108121037, dated Mar. 23, 2023, 8 pages with English translation.

Korean Notice of Reasons for Rejection for Korean Application No. 10-2019-0071646, dated Dec. 20, 2023, 18 pages with English translation.

* cited by examiner

FLUID PUMP WITH DUAL PLUNGERS AND RELATED SYSTEMS AND METHODS

CROSS-REFERENCE TO RELATED APPLICATION

This application is a continuation of U.S. patent application Ser. No. 16/011,015, filed Jun. 18, 2018, now U.S. Pat. No. 10,890,172, issued Jan. 12, 2021, the disclosure of which is hereby incorporated herein in its entirety by this reference.

TECHNICAL FIELD

Embodiments of the present disclosure relate generally to reciprocating fluid pumps that include a reciprocating plunger, to components and devices for use with such pumps, and to methods of using such reciprocating fluid pumps and devices.

BACKGROUND

Reciprocating fluid pumps are used in many industries. Reciprocating fluid pumps generally include two fluid chambers in a pump body. Typically, a reciprocating piston or shaft is driven back and forth within the pump body. Conventionally, one or more plungers (e.g., diaphragms or bellows) are connected to the reciprocating piston or shaft. As the reciprocating piston moves in one direction, the movement of the plungers results in fluid being drawn into a first fluid chamber of the two fluid chambers and expelled from the second chamber. As the reciprocating piston moves in the opposite direction, the movement of the plungers results in fluid being expelled from the first chamber and drawn into the second chamber. A chamber inlet and a chamber outlet may be provided in fluid communication with the first fluid chamber, and another chamber inlet and another chamber outlet may be provided in fluid communication with the second fluid chamber. The chamber inlets to the first and second fluid chambers may be in fluid communication with a common single pump inlet, and the chamber outlets from the first and second fluid chambers may be in fluid communication with a common single pump outlet, such that fluid may be drawn into the pump through the pump inlet from a single fluid source, and fluid may be expelled from the pump through a single pump outlet. Check valves may be provided at the chamber inlet and outlet of each of the fluid chambers to ensure that fluid can only flow into the fluid chambers through the chamber inlets, and fluid can only flow out of the of the fluid chambers through the chamber outlets.

BRIEF SUMMARY

In some embodiments, the present disclosure includes a reciprocating fluid pump for pumping a subject fluid. The reciprocating fluid pump can include a pump body, a subject fluid chamber within the pump body, a first plunger, and a second plunger. The first plunger may be located within the subject fluid chamber of the pump body and may include a first head portion and a first bellows extending from the first head portion, the first plunger configured to expand and compress in a reciprocating action to pump the subject fluid through the subject fluid chamber within the pump body, wherein the first head portion and the first bellows have a first cross-sectional dimension. The second plunger may be located within the subject fluid chamber of the pump body and may include a second head portion and a second bellows extending from the second head portion, the second plunger configured to expand and compress in a reciprocating action to pump the subject fluid through the subject fluid chamber within the pump body, wherein the second head portion and the second bellows have a second cross-sectional dimension that is smaller than the first cross-sectional dimension.

In one or more embodiments, the present disclosure includes a reciprocating fluid pump for pumping a subject fluid. The reciprocating fluid pump may include a pump body, a subject fluid chamber within the pump body, a first plunger, and a second plunger. The first plunger may have a first cross-sectional dimension and located within the subject fluid chamber of the pump body, the first plunger comprising a flexible material and configured to expand and compress in a reciprocating action to pump the subject fluid through the subject fluid chamber within the pump body, and the second plunger may have a second cross-sectional dimension smaller than the first cross-sectional dimension and located within the subject fluid chamber of the pump body, the second plunger comprising a flexible material and configured to expand and compress in a reciprocating action to pump the subject fluid through the subject fluid chamber within the pump body, wherein the first plunger is structurally connected to the second plunger.

Some embodiments of the present disclosure include a method of forming a reciprocating fluid pump. The method may include forming a pump body having a single subject fluid chamber therein, disposing a first plunger within the single subject fluid chamber, the first plunger having a first cross-sectional dimension, disposing a second plunger within the single subject fluid chamber, the second plunger having a second, different cross-sectional dimension that is smaller than the first cross-sectional dimension, and structurally connecting the first plunger to the second plunger.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
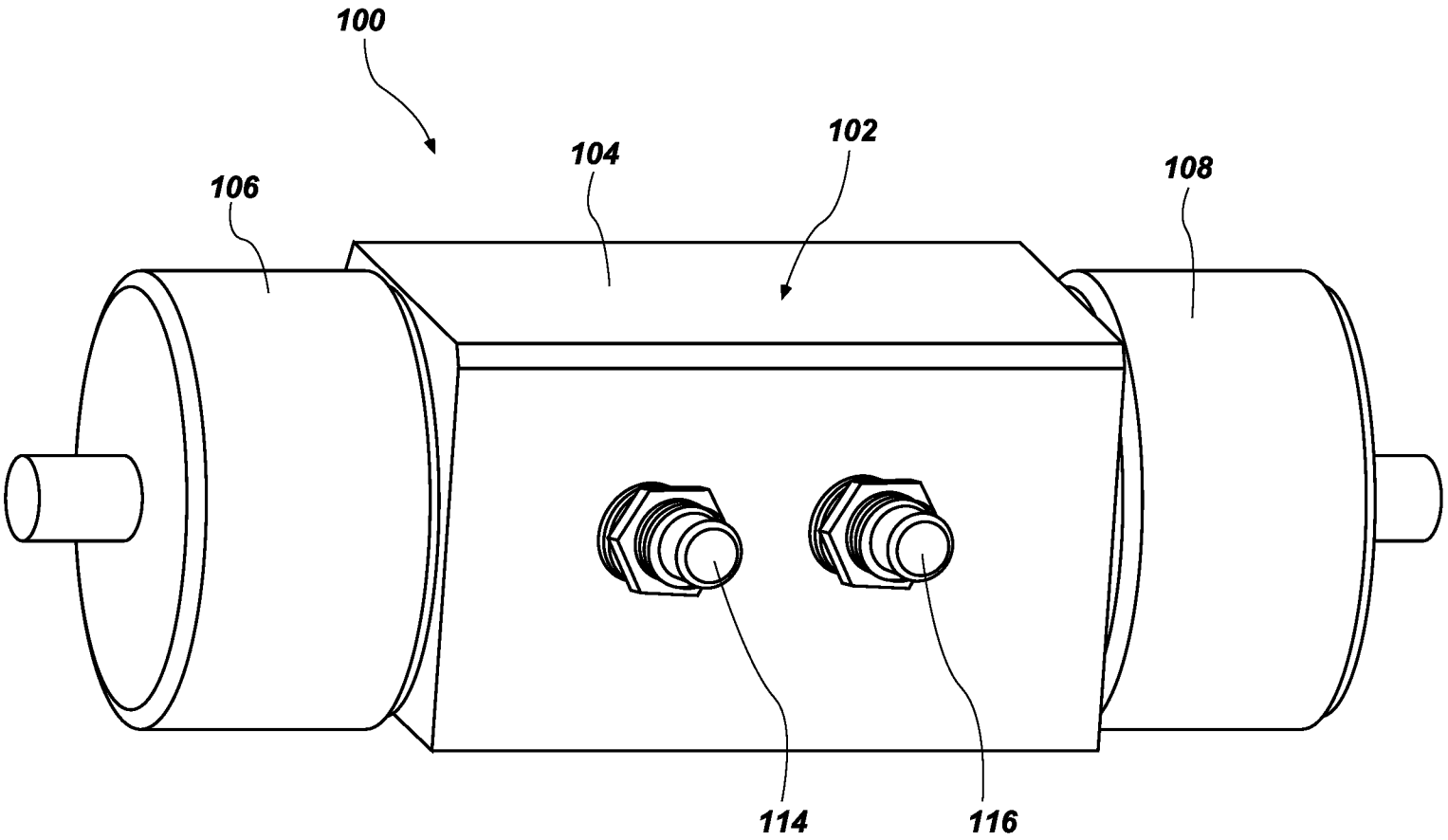
FIG. 1 is a perspective view of a reciprocating fluid pump according to an embodiment of the present disclosure.

The illustrations presented herein may not be, in some instances, actual views of any particular reciprocating fluid pump or component thereof, but may be merely idealized representations that are employed to describe embodiments of the present invention. Additionally, elements common between figures may retain the same numerical designation.

As used herein, any relational term, such as "first," "second," "front," "back," etc., is used for clarity and convenience in understanding the disclosure and accompanying drawings, and does not connote or depend on any specific preference or order, except where the context clearly indicates otherwise.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include reciprocating fluid pumps for pumping subject fluids using a pressurized drive fluid. In some embodiments, a reciprocating fluid pump may include a pump body, a first plunger, a second plunger, and an external controller. The first and second plungers may be disposed within a single subject fluid chamber and may expand and compress longitudinally as the reciprocating fluid pump is cycled during operation thereof. The first plunger may have a first cross-sectional dimension (e.g., diameter) and the second plunger may have a second cross-sectional dimension (e.g., diameter) that is smaller than the first diameter. Accordingly, a size of the subject fluid chamber may be at least partially defined by a difference in cross-sectional dimensions (e.g., diameters) between the first and second plungers. The first and second plungers may be structurally (e.g., physically) connected to each other. As a result, a physical motion of one of the first and second plungers physically affects the motion of the other plunger of the first and second plungers. Accordingly, the motions of the first and second plungers may be operated together and controlled by the external controller.

Because the first and second plungers have different diameters and because the single subject fluid chamber is at least partially defined by the difference in diameters between the first and second plungers, the reciprocating fluid pump of the present disclosure may provide advantages over conventional fluid pumps. For example, the reciprocating fluid pump of the present disclosure may enable relatively small amounts (e.g., flowrates) of subject fluid to be pumped by the reciprocating fluid pump (e.g., microdosing) while utilizing relatively large plungers (e.g., large diaphragms), unlike conventional pumps, which utilize relatively small diaphragms to pump small amounts of subject fluid. Utilizing small diaphragms significantly reduces durability and reliability of the diaphragms. For example, bellows of small diaphragms often fail during use. As a result, the reciprocating fluid pump of the present disclosure may enable relatively small amounts of subject fluid to be pumped by the reciprocating fluid pump while increasing durability and reliability of the reciprocating fluid pump.

FIG. 1 illustrates an embodiment of a reciprocating fluid pump 100 of the present disclosure. In some embodiments, the reciprocating fluid pump 100 is configured to pump a subject fluid, such as, for example, a liquid (e.g., water, oil, acid, etc.), gas, or powdered substance, using a pressurized drive fluid such as, for example, compressed gas (e.g., air). Thus, in some embodiments, the reciprocating fluid pump 100 may comprise a pneumatically operated fluid pump.

The reciprocating fluid pump 100 includes a pump body 102 that may include two or more components that may be assembled together to form the pump body 102. For example, the pump body 102 may include a center body 104, a first end piece 106 that may be attached to the center body 104 on a first side thereof, and a second end piece 108 that may be attached to the center body 104 on an opposite, second side thereof.

The reciprocating fluid pump 100 may also include a subject fluid inlet 114 and a subject fluid outlet 116. During operation of the reciprocating fluid pump 100, the reciprocating fluid pump 100 may draw subject fluid into the reciprocating fluid pump 100 through the subject fluid inlet 114 and may expel the subject fluid out from the reciprocating fluid pump 100 through the subject fluid outlet 116.

Figure 2:
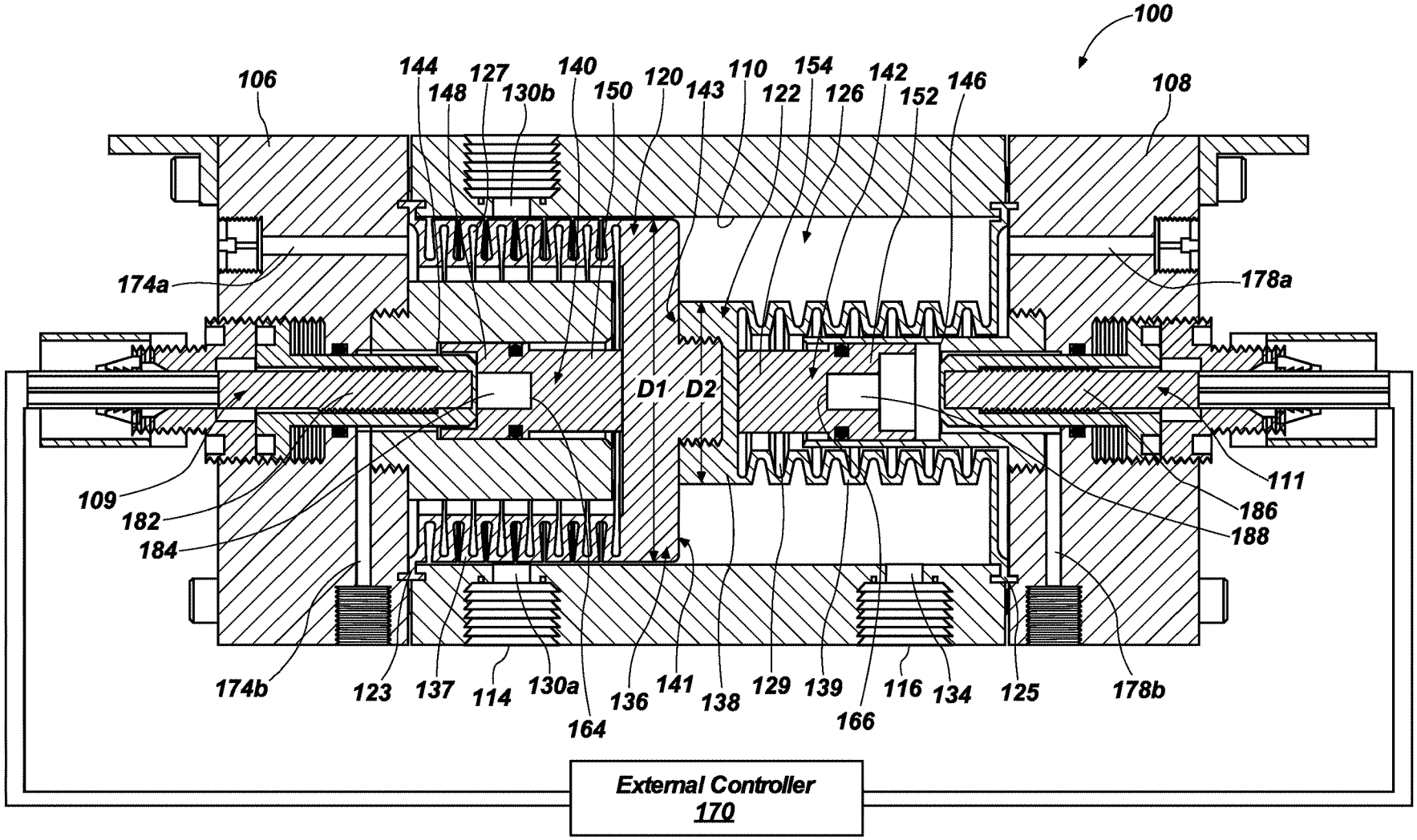
FIG. 2 is a cross-sectional side view of an embodiment of a reciprocating fluid pump according to the present disclosure.

FIG. 2 is a schematic cross-sectional side view of the reciprocating fluid pump 100 of FIG. 1. The reciprocating fluid pump 100 includes a first plunger 120, a second plunger 122, a first piston chamber 144, a second piston chamber 146, a first piston 140, a second piston 142, a first sensor assembly 109, and a second sensor assembly 111. The pump body 102 may include therein (e.g., may house) a cavity 110. The first plunger 120 and the second plunger 122 may be disposed within the cavity 110. The first and second plungers 120, 122 may each be formed of and include a flexible polymer material (e.g., a thermoset or a thermoplastic material). As is discussed in further detail below, each of the first and second plungers 120, 122 may comprise, for example, a diaphragm and/or a bellows (as shown in the figures). Furthermore, the first and second plungers 120, 122 may expand and compress longitudinally within the cavity 110 as the reciprocating fluid pump 100 is cycled (i.e., in the left and right horizontal directions from the view shown in FIG. 2) during operation thereof.

The first and second plungers 120, 122 may divide the cavity 110 into a subject fluid chamber 126 on an exterior of the first and second plungers 120, 122, a first drive fluid chamber 127 on an interior of the first plunger 120 (e.g., within a bellows of the first plunger 120), and a second drive fluid chamber 129 on an interior of the second plunger 122 (e.g., within a bellows of the second plunger 122). As shown in FIG. 2, the first and second plungers 120, 122 may be structurally (e.g., physically) connected to each other. As a result, a physical motion of one of the first and second plungers 120, 122 physically affects (e.g., drives) the motion of the other plunger of the first and second plungers 120, 122. Accordingly, the motions of the first and second plungers 120, 122 may be operated together and controlled by the external controller 170, as is discussed in further detail below.

The first plunger 120 may have a first outer diameter D1 and the second plunger 122 may have a second outer diameter D2. The second outer diameter D2 of the second plunger 122 may be smaller than the first outer diameter D1 of the first plunger 120. For example, in some embodiments, a ratio of the first outer diameter D1 of the first plunger 120 to the second outer diameter D2 of the second plunger 122 may be within a range of about 1.10 to about 3.00. In one or more embodiments, the ratio of the first outer diameter D1 of the first plunger 120 to the second outer diameter D2 of the second plunger 122 may be about 1.20. In additional embodiments, the ratio of the first outer diameter D1 of the first plunger 120 to the second outer diameter D2 of the second plunger 122 may be about 2.00. Furthermore, while specific ratios are described herein, one of ordinary skill in the art will readily recognize that any ratio greater than 1.00 (e.g., 3.00, 5.00, 10.00, or greater) is within the scope of the present disclosure.

In some embodiments, the first outer diameter D1 of the first plunger 120 and an inner diameter of the subject fluid chamber 126 may be at least substantially the same (e.g., within 1 to 10 hundredths of an inch). For example, the first outer diameter D1 of the first plunger 120 may be just slightly smaller than the inner diameter of the subject fluid chamber 126 in order to allow the first plunger 120 to fit within the subject fluid chamber 126. As a result, in some embodiments, a ratio of the inner diameter of the subject fluid chamber 126 to the second diameter D2 of the second plunger 122 may be within a range of about 1.10 to about 3.00. As is discussed in greater detail below, a flow rate of the subject fluid through the reciprocating fluid pump 100 (e.g., caused by the reciprocating fluid pump 100) is based at least partially on a difference in size of diameters D1, D2 between the first plunger 120 and the second plunger 122.

In one or more embodiments, the first plunger 120 may include a first head portion 136 and a first bellows 137 extending from the first head portion 136 of the first plunger 120. Additionally, the second plunger 122 may include a second head portion 138 and a second bellows 139 extending from the second head portion 138 of the second plunger 122. Furthermore, the first head portion 136 of the first plunger 120 may include a first plunger face 141 opposite the first bellows 137 of the first plunger 120, and the second head portion 138 of the second plunger 122 may include a second plunger face 143 opposite the second bellows 139 of the second plunger 122.

When disposed within the subject fluid chamber 126 in an orientation for operation, the first plunger face 141 of the first plunger 120 may face the second plunger face 143 of the second plunger 122. Furthermore, in some embodiments, the first plunger face 141 of the first plunger 120 may be in physical contact with the second plunger face 143 of the second plunger 122. Moreover, in some instances, a portion of the first head portion 136 of the first plunger 120 may be threaded into a portion of the second head portion 138 of the second plunger 122, or vice versa. In additional embodiments, the first head portion 136 of the first plunger 120 and the second head portion 138 of the second plunger 122 may be a single integral body. Additionally, in one or more embodiments, the first plunger 120 and the second plunger 122 may be a single integral body.

A peripheral edge 123 of the first plunger 120 may be attached to the pump body 102, and a fluid tight seal may be provided between the pump body 102 and the first plunger 120. Similarly, a peripheral edge 125 of the second plunger 122 may be attached to the pump body 102, and a fluid tight seal may be provided between the pump body 102 and the second plunger 122.

Referring still to FIG. 2, the pump body 102 may include a subject fluid inlet pathway 130*a*, 130*b* that leads from the subject fluid inlet 114 and into the subject fluid chamber 126 through the pump body 102, and the pump body 102 may include a subject fluid outlet pathway 134 that leads out from the subject fluid chamber 126 and to the subject fluid outlet 116 through the pump body 102. Accordingly, subject fluid may be drawn into the reciprocating fluid pump 100 through the subject fluid inlet 114 from a single fluid source, and subject fluid may be expelled from the reciprocating fluid pump 100 through the subject fluid outlet 116. In some embodiments, the subject fluid inlet pathway 130 may include two or more subject fluid inlet pathways 130*a*, 130*b*.

Furthermore, the reciprocating fluid pump 100 may include one or more subject fluid inlet check valves and one or more subject fluid outlet check valves disposed within the subject fluid inlet pathway 130 and the subject fluid outlet pathway 134. For example, the subject fluid inlet check valve may be provided proximate the subject fluid inlet pathway 130 to ensure that fluid is capable of flowing into the subject fluid chamber 126 through the subject fluid inlet pathway 130, but incapable of flowing out from the subject fluid chamber 126 through the subject fluid inlet pathway 130. The subject fluid outlet check valve may be provided proximate the subject fluid outlet pathway 134 to ensure that fluid is capable of flowing out from the subject fluid chamber 126 through the subject fluid outlet pathway 134, but incapable of flowing into the subject fluid chamber 126 through the first subject fluid outlet pathway 134. The check valves may include any suitable valve that allows flow in one direction and restricts flow in an opposite direction, such as, for example, a ball check valve, a diaphragm check valve, a magnet check valve, etc. For example, may include one or more of the ball check valves described in U.S. patent application Ser. No. 14/262,146, to Simmons, filed Apr. 25, 2014 (US 2014/0334957 A1), the disclosure of which is incorporated in its entirety by reference herein.

Referring still to FIG. 2, the first piston 140 may include a first piston head 148 and a first shaft 150. The second piston 142 may include a second piston head 152 and a second shaft 154. The first shaft 150 may extend from the first piston head 148 on one longitudinal end and may be coupled to the first plunger 120 on a second opposite longitudinal end. The first shaft 150 may be coupled to a side of the first plunger 120 facing the first drive fluid chamber 127 (i.e., opposite the first plunger face 141). For example, the first shaft 150 may extend from the first piston head 148 and into the first plunger 120 (e.g., through a bellows of the first plunger 120).

Furthermore, the second shaft 154 may extend from the second piston head 152 on one longitudinal end and may be coupled to the second plunger 122 on a second opposite longitudinal end. The second shaft 154 may be coupled to a side of the second plunger 122 facing the second drive fluid chamber 129 (i.e., opposite the second plunger face 143). For example, the second shaft 154 may extend from the second piston head 152, and into the second plunger 122 (e.g., through a bellows of the second plunger 122).

The first sensor assembly 109 may extend from an exterior of the reciprocating fluid pump 100 and into an interior of the first end piece 106. The second sensor assembly 111 may extend from the exterior of the reciprocating fluid pump 100 and into an interior of the second end piece 108. As is discussed in greater detail below, an external controller 170 of the reciprocating fluid pump 100 may utilize the first and second sensor assemblies 109, 111 to operate the reciprocating fluid pump 100.

In some embodiments, the first piston head 148 of the first piston 140 may include a first sensor-receiving cavity 164. The first sensor-receiving cavity 164 may extend at least partially through the first piston head 148. Additionally, the second shaft 154 of the second piston 142 may include a second sensor-receiving cavity 166. The second sensor-receiving cavity 166 may extend at least partially through the second piston head 152. The first and second sensor-receiving cavities 164, 166 may be sized and shaped to receive at least a portion of the first and second sensor assemblies 109, 111, respectively.

In some embodiments, the first sensor assembly 109 may include a first sensor portion 182 and a first target portion 184. The first sensor portion 182 may be disposed within and may extend through the first piston chamber 144. Furthermore, the first sensor portion 182 may extend at least partially into the first sensor-receiving cavity 164 of the first shaft 150 of the first piston 140. The first target portion 184 of the first sensor assembly 109 may be disposed in a base (i.e., an interior end) of the first sensor receiving cavity 164. The first sensor portion 182 may be configured to determine a proximity of the first sensor portion 182 to the first target portion 184.

Additionally, in some embodiments, the second sensor assembly 111 may include a second sensor portion 186 and a second target portion 188. The second sensor portion 186 may be disposed within and may extend through the second piston chamber 146. Furthermore, the second sensor portion 186 may extend at least partially into the second sensor-receiving cavity 166 of the second shaft 154 of the second piston 142. The second target portion 188 of the second sensor assembly 111 may be disposed within a base (i.e., an interior end) of the first sensor-receiving cavity 164. The second sensor portion 186 may be configured to determine a proximity of the second sensor portion 186 to the second target portion 188.

In some embodiments, the first and second sensor assemblies 109, 111 may include magnetic proximity sensors and targets. In additional embodiments, the first and second sensor assemblies 109, 111 may include inductive proximity sensors and targets. In further embodiments, the first and second sensor assemblies 109, 111 may include optical proximity sensors and targets.

Referring still to FIG. 2, in some embodiments, the first end piece 106 may include one or more first drive fluid inlets 174*a*, 174*b* extending through a wall of the first end piece 106. The one or more first drive fluid inlets 174*a*, 174*b* may provide drive fluid flow paths to the first drive fluid chamber 127 (the drive fluid chamber within the bellows of the first plunger 120) and to the first piston chamber 144. Furthermore, in some instances, the one or more first drive fluid inlets 174*a*, 174*b* may serve as a drive fluid outlet for the first piston chamber 144. Furthermore, the one or more first drive fluid inlets 174*a*, 174*b* may each include at least one valve (e.g., a check valve) that may restrict fluid flow in at least one direction during particular operations of the reciprocating fluid pump 100.

Furthermore, the second end piece 108 may include one or more second drive fluid inlets 178*a*, 178*b* extending through a wall of the second end piece 108. The one or more second drive fluid inlets 178*a*, 178*b* may provide a drive fluid flow paths to the second drive fluid chamber 129 (the drive fluid chamber within the bellows of the second plunger 122) and to the second piston chamber 146. Furthermore, in some instances, the one or more second drive fluid inlets 178*a*, 178*b* may serve as a drive fluid outlet for the second piston chamber 146. Furthermore, the one or more second drive fluid inlets 178*a*, 178*b* may each include at least one valve (e.g., a check valve) that may restrict fluid flow in at least one direction during particular operations of the reciprocating fluid pump 100.

During operation, the first plunger 120 is capable of expanding in the rightward direction and compressing in the leftward direction from the perspective of FIG. 2. Similarly, the second plunger 122 is capable of expanding in the leftward direction and compressing in the rightward direction from the perspective of FIG. 2. Put another way, the first and second plungers 120, 122 may cycle through compression and expansion strokes during operation.

As the first plunger 120 expands (i.e., moves through an expansion stroke) and the second plunger 122 compresses (i.e., moves through a compression stroke), a volume of the first drive fluid chamber 127 increases, a volume of the subject fluid chamber 126 decreases, and a volume of the second drive fluid chamber 129 decreases. As a result, subject fluid may be expelled from the subject fluid chamber 126 through the subject fluid outlet pathway 134. The first plunger 120 may be extended at least partially by providing pressurized drive fluid within the first drive fluid chamber 127. Furthermore, the second plunger 122 may be compressed by the first plunger 120 expanding and venting the second piston chamber 146 and the second drive fluid chamber 129.

Conversely, as the second plunger 122 expands (i.e., moves through an expansion stroke) and the first plunger 120 compresses (i.e., moves through a compression stroke), the volume of the second drive fluid chamber 129 increases, the volume of the subject fluid chamber 126 increases, and the volume of the first drive fluid chamber 127 decreases. As a result, subject fluid may be drawn into the subject fluid chamber 126 through the subject fluid inlet pathway 130. The second plunger 122 may be expanded and the first plunger 120 may be compressed at least partially by the second plunger 122 expanding and venting the first piston chamber 144 and the first drive fluid chamber 127. As is discussed in greater detail below, compression and expansion of the first and second plungers 120, 122 may be controlled by an external controller 170.

In order to commence an expansion stroke of the first plunger 120, pressurized drive fluid may be inserted through the one or more of the first drive fluid inlets 174*a*, 174*b* of the first end piece 106 of the reciprocating fluid pump 100. For example, in some instances, pressurized drive fluid (e.g., air) may be inserted through the one or more first drive fluid inlets 174*a*, 174*b* into the first drive fluid chamber 127 and into the first piston chamber 144. As a result, the first drive fluid chamber 127 and the first piston chamber 144 may be pressurized with the pressurized drive fluid, which may cause the first plunger 120 to commence an expansion stroke. Put another way, pressurizing the first drive fluid chamber 127 and the first piston chamber 144 may cause the first plunger 120 (and the bellows of the first plunger 120) to expand.

As the first plunger 120 moves through an expansion stroke, subject fluid within the subject fluid chamber 126 may be expelled from the subject fluid chamber 126, through the subject fluid outlet pathway 134, and through the subject fluid outlet 116.

After expelling the subject fluid from the subject fluid chamber 126, in order to commence a compression stroke of the first plunger 120, the first drive fluid chamber 127 and the first piston chamber 144 may be depressurized (e.g., vented to ambient, a reduced pressure area, or a vacuum). As is discussed below, the first plunger 120 is compressed due to an expansion stroke of the second plunger 122. As the first plunger 120 moves through a compression stroke, subject fluid may be drawn through the subject fluid inlet pathway 130 and into the subject fluid chamber 126.

In order to commence an expansion stroke of the second plunger 122, pressurized drive fluid may be inserted through the one or more second drive fluid inlets 178*a*, 178*b* of the second end piece 108 of the reciprocating fluid pump 100. For example, in some instances, pressurized drive fluid may be inserted through the one or more second drive fluid inlets 178*a*, 178*b* into the second drive fluid chamber 129 and into the second piston chamber 146. As a result, the second drive fluid chamber 129 and the second piston chamber 146 may be pressurized with the pressurized drive fluid, which may cause the second plunger 122 to commence an expansion stroke. Put another way, pressurizing the second drive fluid chamber 129 and the second piston chamber 146 may cause the second plunger 122 (and the bellows of the second plunger 122) to expand. As the second plunger 122 moves through an expansion stroke, subject fluid may be drawn into the subject fluid chamber 126 through the subject fluid inlet pathway 130.

After drawing subject fluid into the subject fluid chamber 126, in order to commence a compression stroke of the second plunger 122, the second drive fluid chamber 129 and the second piston chamber 146 may be depressurized (e.g., vented to ambient, a reduced pressure, or even a vacuum), and the first plunger 120 may be moved through an expansion stroke (discussed above). As the second plunger 122 moves through a compression stroke, subject fluid may be expelled from the subject fluid chamber 126 and through the subject fluid outlet pathway 134.

Thus, to drive the pumping action of the reciprocating fluid pump 100, the first drive fluid chamber 127 and the second drive fluid chamber 129 may be pressurized in an alternating or cyclic manner to cause the first plunger 120 and the second plunger 122 to reciprocate back and forth (e.g., move through sequential expansion and compression strokes) within the pump body 102, as discussed above.

In some embodiments, as will be understood by one of ordinary skill in the art, the reciprocating fluid pump 100 may comprise a shifting mechanism for shifting the flow of pressurized drive fluid back and forth between the first drive fluid chamber 127 and the second drive fluid chamber 129. In some instances, the shifting mechanism may comprise, for example, the first and second pistons 140, 142 and a shuttle valve. For example, the reciprocating fluid pump 100 may include a shuttle valve assembly as described in U.S. patent application Ser. No. 13/228,934, to Simmons et al., filed Sep. 9, 2011, the disclosure of which is incorporated in its entirety by reference herein.

Referring to FIG. 2 again, as noted above, in one or more embodiments, the pumping action (e.g., the expansion and compression strokes of the first and second plungers 120, 122) may be operated by the external controller 170. In particular, the external controller 170 may be operably coupled to a drive fluid source (e.g., a source of compressed air) and may control when and where drive fluid is inserted into the reciprocating fluid pump 100. In some embodiments, the external controller 170 may include a programmable logic controller (PLC). For instance, the external controller 170 may include a digital computer that has been ruggedized and adapted for controlling processes (e.g., pumping fluid). In some embodiments, the external controller 170 can include a RIO-47100 made by GALIL™ or any other PLC known in the art.

In one or more embodiments, the external controller 170 may be operably coupled to the first sensor assembly 109 and the second sensor assembly 111 of the reciprocating fluid pump 100. As mentioned above, the first sensor assembly 109 may be disposed within the first end piece 106 of the reciprocating fluid pump 100, and the second sensor assembly 111 may be disposed within the second end piece 108 of the reciprocating fluid pump 100. Furthermore, as discussed above, the first and second sensor portions of the first and second sensor assemblies 109, 111 are configured to determine proximities of the first and second sensor portions to the first and second target portions, respectively.

Based on the determined proximity of the first sensor portion 182 to the first target portion 184 and the determined proximity of the second sensor portion 186 to the second target portion 188, the external controller 170 may operate the expansion and compression strokes of the first plunger 120 and the second plunger 122. For example, during a pumping action of the reciprocating fluid pump 100, the external controller 170 may utilize the first and second sensor assemblies 109, 111 to sense the ends of expansion and compression strokes of the first plunger 120 and the second plunger 122. For instance, when the external controller 170 senses (via the first sensor assembly 109) that the first sensor portion 182 of the first sensor assembly 109 is in a most proximate position relative to the first target portion 184 of the first sensor assembly 109, the external controller 170 may determine that the first plunger 120 is at an end of a compression stroke. Furthermore, based on determining that the first plunger 120 is at an end of a compression stroke, the external controller 170 can cause pressurized drive fluid to be inserted into the first piston chamber 144 and the first drive fluid chamber 127 in order to commence an expansion stroke of the first plunger 120.

Conversely, when the external controller 170 senses (via the first sensor assembly 109) that the first sensor portion 182 of the first sensor assembly 109 is in a least proximate (i.e., most distant) position relative to the first target portion 184 of the first sensor assembly 109, the external controller 170 may determine that the first plunger 120 is at an end of an expansion stroke, the external controller 170 can cause the first drive fluid chamber 127 and the first piston chamber 144 to be depressurized and can cause pressurized drive fluid to be inserted into the second piston chamber 146 to commence a compression stroke of the first plunger 120. Furthermore, the external controller 170 may utilize the second sensor assembly 111 in a similar manner to move the second plunger 122 through expansion and compression strokes. In view of the foregoing, the external controller 170 may utilize the first and second sensor assemblies 109, 111 to determine when to signal respective valves (e.g., valves within the first and second drive fluid inlets 174*a*, 174*b*, 178*a*, and 178*b*, respectively), to independently pressurize and vent the first drive fluid chamber 127 and the second drive fluid chamber 129 (e.g., cause and control the expansion and compression strokes of the first and second plungers 120, 122).

As noted above, the reciprocating fluid pump 100 may pump subject fluid based on size differences (e.g., differences in diameters D1, D2) of the first and second plungers 120, 122. In particular, the size of the subject fluid chamber 126 is determined (e.g., defined) based on the size difference between the first plunger 120 and the second plunger 122. As result, how much subject fluid is drawn into and expelled from the subject fluid chamber 126 during each complete stroke (e.g., an expansion and compression stroke of each plunger) of the reciprocating fluid pump 100 is determined based on the size difference between the first plunger 120 and the second plunger 122. For example, if the first and second plungers 120, 122 are relatively close to the same size, the size of the subject fluid chamber 126 will be relatively small, and the amount of fluid pumped during each stroke of the reciprocating fluid pump 100 will be relatively small. Furthermore, the size of the subject fluid chamber 126 increases with increasing difference between the size of the first plunger 120 and the size of the second plunger 122. Thus, an amount of fluid to be pumped during each stroke of the reciprocating fluid pump 100 may be selected based on the difference in size of the first and second plungers 120, 122.

Referring still to FIG. 2, in some embodiments, the inner diameter of the cavity 110 may be about 3.0 inches and the second diameter D2 of the second plunger 122 may be about 1.5 inches. Furthermore, a distance that the first and second plungers 120, 122 may translate back and forth longitudinally within the cavity 110 may be about 1.5 inches. Accordingly, during a complete cycle of the reciprocating fluid pump 100, the reciprocating fluid pump 100 may pump (e.g., eject) about 8.0 $in^3$ of the subject fluid. Although specific diameters of the first and second plungers 120, 122 and a specific distance of translation are provided, one of ordinary skill in the art will readily recognize the diameters D1, D2 of the first and second plungers 120, 122 may be any size and that the distance of translation may be any size. For example, the first diameter D1 of the first plunger 120 may be within a range of about 1.0 inch to about 6.0 inches, and the second diameter D2 of the second plunger 122 may be within a range of about 0.5 inches to about 5.5 inches. Furthermore, the distance of translation may be within a range of about 0.5 inches to about 2.0 inches.

As a result of the foregoing, the reciprocating fluid pump 100 of the present disclosure may provide advantages over conventional fluid pumps. For example, the reciprocating fluid pump 100 of the present disclosure may enable relatively small amounts of subject fluid (e.g., microdosing) to be pumped by the reciprocating fluid pump 100 while utilizing relatively large plungers (e.g., large diaphragms), unlike conventional pumps, which utilize relatively small diaphragms to pump small amounts of subject fluid. Utilizing small diaphragms significantly reduces durability and reliability of the diaphragms. For example, bellows of small diaphragms often fail during use. As a result, increase the reciprocating fluid pump 100 of the present disclosure may enable relatively small amounts (e.g., small flowrates) of subject fluid (e.g., microdosing) to be pumped by the reciprocating fluid pump 100 while increasing durability and reliability of the reciprocating fluid pump 100.

Although the reciprocating fluid pump 100 of FIGS. 1 and 2 is shown as employing two plungers, additional embodiments of fluid pumps of the present disclosure may include more than two plungers. Additionally, in some embodiments, the reciprocating fluid pump 100 may include two plungers that form a single integral part, wherein diameters on each end of the single integral part are sized differently.

Figure 3:
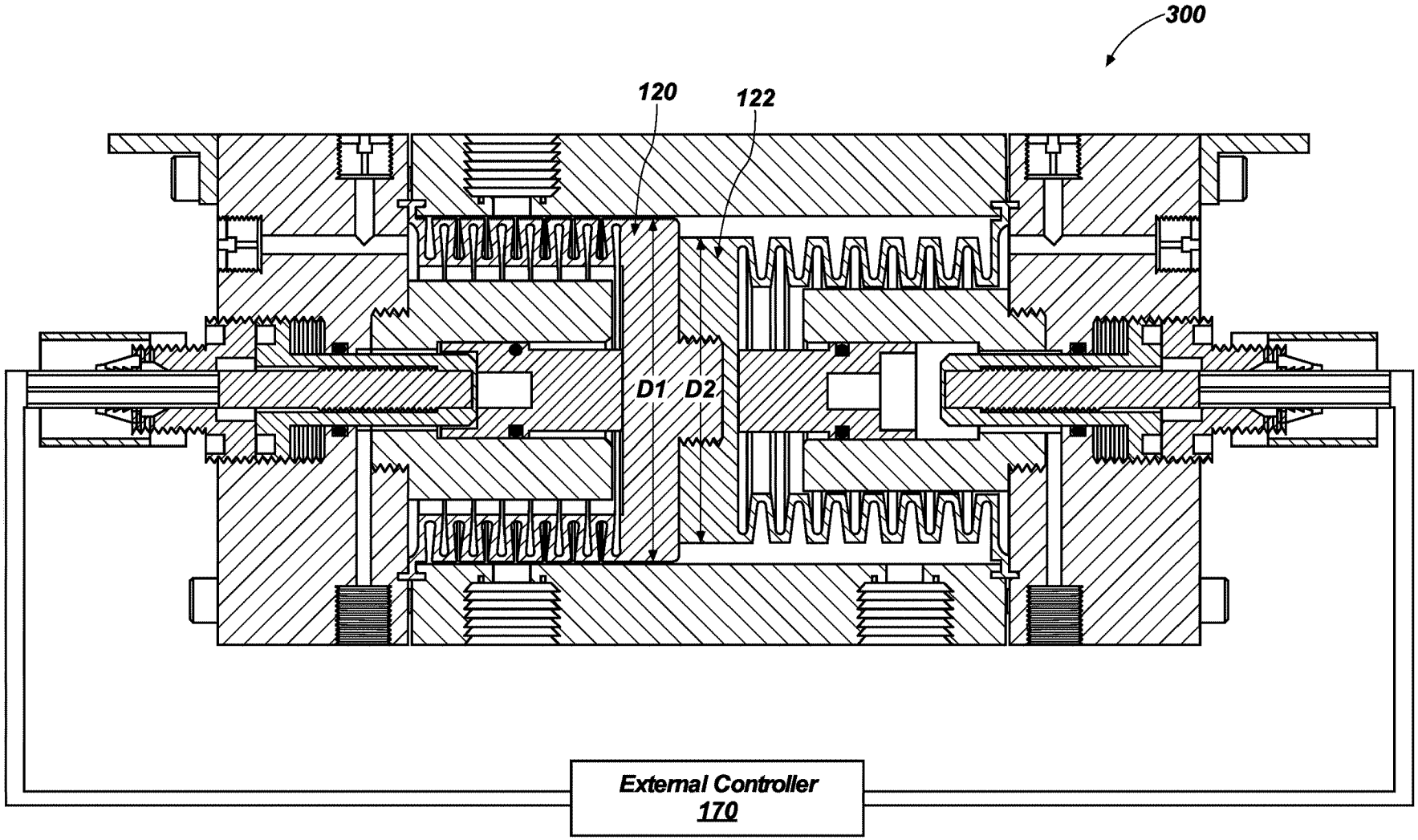
FIG. 3 is cross-sectional side view of another embodiment of a reciprocating fluid pump according to the present disclosure.

FIG. 3 includes a schematic side cross-sectional view of a reciprocating fluid pump 300 having a different ratio of the first outer diameter D1 of the first plunger 120 to the second outer diameter D2. In particular, in the embodiment of FIG. 3, the ratio of the first outer diameter D1 of the first plunger 120 to the second outer diameter D2 is about 1.2.

Figure 4:
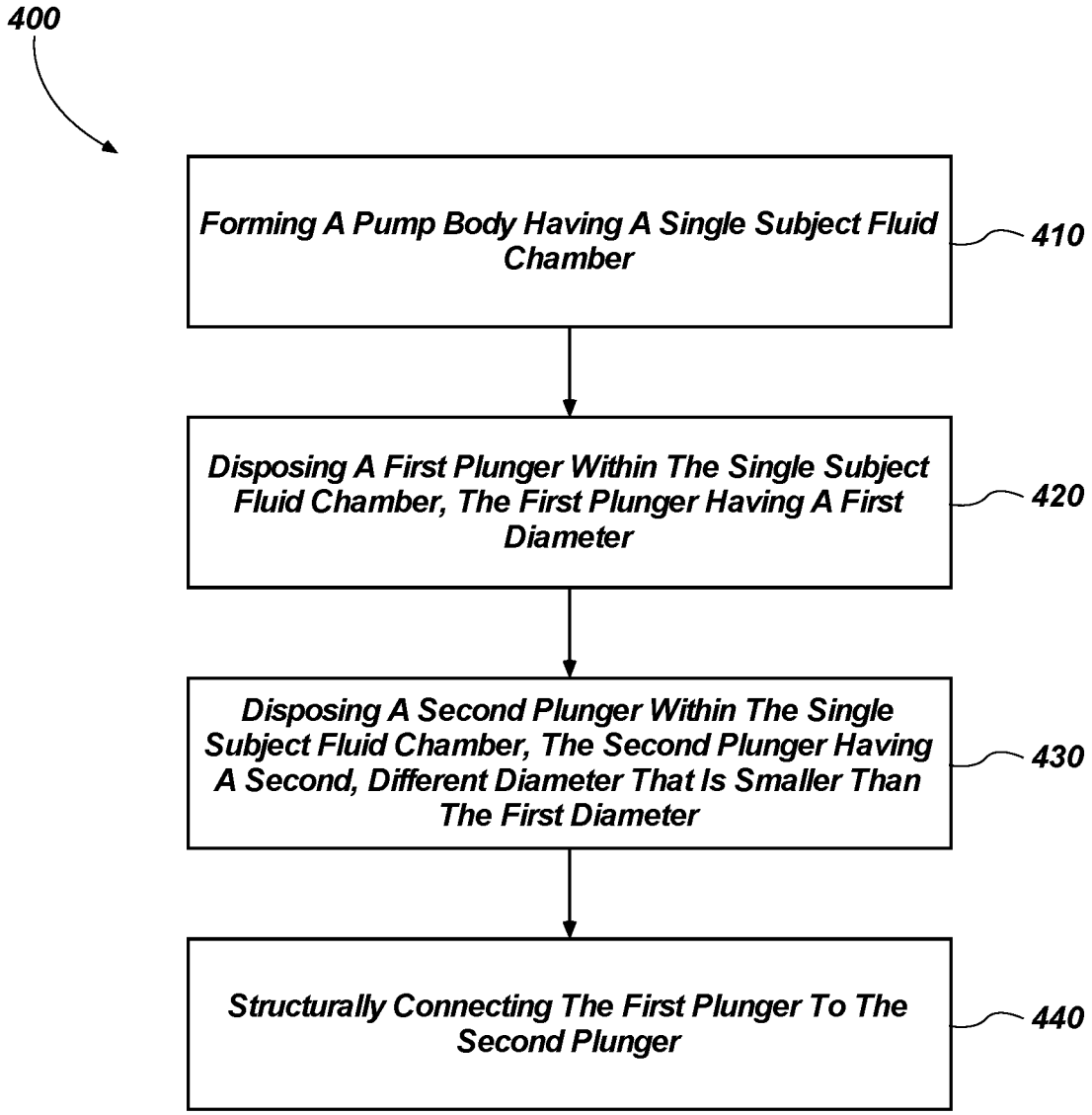
FIG. 4 shows a flow chart of an embodiment of a method of forming a reciprocating fluid pump according to the present disclosure.

FIG. 4 shows a flow chart of a method 400 of forming a reciprocating fluid pump 100 according to one or more embodiments of the present disclosure. In some embodiments, the method 400 may include act 410 of forming a pump body 102. For example, act 410 may include forming a pump body 102 having a single subject fluid chamber 126. In some instances, act 410 may include attaching a first end piece 106 and a second end piece 108 to a center body 104. In one or more embodiments, act 410 may include forming the pump body 102 according to any of the configurations described above in regard to FIGS. 1-3.

The method 400 may further include act 420 of disposing a first plunger 120 within the single subject fluid chamber 126. For instance, act 420 may include disposing the first plunger 120 within the single subject fluid chamber 126, the first plunger 120 having a first diameter D1. In some embodiments, act 420 may include disposing a first plunger 120 have a first head portion 136 and a first bellows 137 within the single subject fluid chamber 126.

Additionally, the method 400 may include act 430 of disposing a second plunger 122 within the single subject fluid chamber 126. For instance, act 430 may include disposing the second plunger 122 within the single subject fluid chamber 126, the second plunger 122 having a second, different diameter D2 that is smaller than the first diameter D1. In some embodiments, act 430 may include disposing a second plunger 122 have a second head portion 138 and a second bellows 139 within the single subject fluid chamber 126. In one or more embodiments, acts 420 and 430 may include dividing a cavity 110 of the pump body 102 into a subject fluid chamber 126 on an exterior of the first and second plungers 120, 122, a first drive fluid chamber 127 on an interior of the first plunger 120 (e.g., within a bellows of the first plunger 120), and a second drive fluid chamber 129 on an interior of the second plunger 122 (e.g., within a bellows of the second plunger 122). Moreover, acts 420 and 430 may include disposing the first and second plungers 120, 122 within the subject fluid chamber 126 according to any of the configurations described above in regard to FIGS. 2 and 3.

Moreover, the method 400 may include act 440 of structurally connecting the first plunger 120 to the second plunger 122. For example, act 440 may include threading a portion of the first plunger 120 into a portion of the second plunger 122. Furthermore, act 440 may include structurally connection the first and second plungers 120, 122 according to any suitable manner (e.g., adhesive, fasteners, integrally forming the first and second plungers 120, 122). Additionally, act 440 may include connecting the first and second plungers 122 according to any of the configurations described above in regard to FIGS. 2 and 3.

In some embodiments, the method 400 may further include selecting the first plunger 120 and the second plunger 122 to have a ratio of the first diameter D1 of the first plunger 120 and the second diameter D2 of the second plunger 122 within a range of about 1.10 to about 3.00. In additional embodiments, the method 400 may include selecting the diameters D1, D2 of the first plunger 120 and the second plunger 122 to have a ratio of about 1.20. In further embodiments, the method 400 may include selecting the diameters D1, D2 of the first plunger 120 and the second plunger 122 to have a ratio of about 2.00.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A reciprocating fluid pump for pumping a subject fluid, comprising:

a pump body having an interior cylindrical surface defining a subject fluid chamber;

a first plunger disposed within the subject fluid chamber of the pump body and having a first outer diameter that is substantially equal to an inner diameter of the interior cylindrical surface of the subject fluid chamber, the first plunger including:

a first head portion having the first outer diameter; and a first shaft extending from the first head portion, the first shaft having a diameter smaller than the first outer diameter; and a second plunger disposed within the subject fluid chamber of the pump body and having a second outer diameter that is different than the first outer diameter, the second plunger including:

a second head portion having the second outer diameter, the second head portion directly adjoining the first head portion on a side of the first head portion opposite the first shaft; and a second shaft extending from the second head portion in a direction opposite a position of the first head portion, the second shaft having a diameter smaller than the second outer diameter.

2. The reciprocating fluid pump of claim 1, wherein the inner diameter of the subject fluid chamber is substantially uniform along a longitudinal length of the subject fluid chamber.

3. The reciprocating fluid pump of claim 1, wherein the first plunger and the second plunger share a common longitudinal axis.

4. The reciprocating fluid pump of claim 1, wherein a ratio of the first outer diameter of the first plunger and the second outer diameter of the second plunger is within a range of about 1.10 to about 3.00.

5. The reciprocating fluid pump of claim 4, wherein the ratio of the first outer diameter of the first plunger and the second outer diameter of the second plunger is about 1.20.

6. The reciprocating fluid pump of claim 4, wherein the ratio of the first outer diameter of the first plunger and the second outer diameter of the second plunger is about 2.00.

7. The reciprocating fluid pump of claim 1, wherein substantially all of a fluid volume of the subject fluid chamber is substantially defined radially between the interior cylindrical surface of the subject fluid chamber and the second outer diameter of the second plunger and axially between an end face of the first plunger and an end of the fluid chamber.

8. The reciprocating fluid pump of claim 1, wherein the first plunger is structurally connected to the second plunger including a portion of one of the first head portion and the second head portion threaded into an other of the first head portion and the second head portion.

9. The reciprocating fluid pump of claim 1, wherein the first plunger comprises a first plunger face at an axial end thereof, and wherein the second plunger comprises a second plunger face at an axial end thereof that adjoins and is in physical contact with the first plunger face of the first plunger.

10. A reciprocating fluid pump for pumping a subject fluid, comprising:

a pump body having an interior cylindrical surface defining a subject fluid chamber;

a first plunger disposed within the subject fluid chamber of the pump body and having a first outer diameter that is substantially equal to an inner diameter of the subject fluid chamber; and a second plunger disposed within the subject fluid chamber of the pump body;

a first sensor assembly including a first target portion positioned within the first plunger and a first sensor portion extending from an exterior of the pump body and at least partially into the first plunger and configured to sense the first target portion;

a second sensor assembly including a second target portion positioned within the second plunger and a second sensor portion extending from the exterior of the pump body and at least partially into the second plunger and configured to sense the second target portion; and a controller configured to determine a proximity of the first sensor portion to the first target portion and a proximity of the second sensor portion to the second target portion.

11. The reciprocating fluid pump of claim 10, wherein a flow rate of the subject fluid caused by the reciprocating fluid pump is based at least partially on a difference between the inner diameter of the subject fluid chamber and a second outer diameter of the second plunger.

12. The reciprocating fluid pump of claim 10, wherein the first plunger comprises a first head portion and a first bellows extending from the first head portion in a direction opposite the second plunger, and wherein the second plunger comprises a second head portion and a second bellows extending from the second head portion in a direction opposite the first plunger.

13. The reciprocating fluid pump of claim 12, further comprising:

a first drive fluid chamber at least partially defined within the first bellows of the first plunger; and a second drive fluid chamber at least partially defined within the second bellows of the second plunger.

14. The reciprocating fluid pump of claim 10, wherein:

the first target portion is coupled to the first plunger and oriented on a center longitudinal axis of the subject fluid chamber; and the first sensor portion is coupled to the pump body and oriented on the center longitudinal axis of the subject fluid chamber.

15. The reciprocating fluid pump of claim 14, wherein:

the second target portion is coupled to the second plunger and oriented on the center longitudinal axis of the subject fluid chamber; and the second sensor portion is coupled to the pump body and oriented on the center longitudinal axis of the subject fluid chamber.

16. The reciprocating fluid pump of claim 10, wherein the controller is configured to determine ends of expansion and compression strokes of the first plunger and the second plunger using the determined proximity of the first target portion to the first sensor portion and the determined proximity of the second sensor portion to the second sensor portion.

17. A method of forming a reciprocating fluid pump, the method comprising:

forming a pump body having an interior cylindrical surface defining a subject fluid chamber therein;

disposing a first plunger within the subject fluid chamber, the first plunger having a first outer diameter that is at least substantially equal to an inner diameter of the interior cylindrical surface of the subject fluid chamber, the first plunger including: a first head portion having the first outer diameter; and a first shaft extending from the first head portion, the first shaft having a diameter smaller than the first outer diameter;

disposing a second plunger within the subject fluid chamber, the second plunger having a second outer diameter that is smaller than the first outer diameter, the second plunger including: a second head portion having the second outer diameter; and a second shaft extending from the second head portion in a direction opposite a position of the first head portion, the second shaft having a diameter smaller than the second outer diameter; and structurally connecting the first head portion to the second head portion with the second head portion directly adjoining the first head portion.

18. The method of claim 17, further comprising:

coupling a first target portion of a first sensor assembly to the first plunger along a center longitudinal axis of the subject fluid chamber;

coupling a first sensor portion of the first sensor assembly to the pump body along the center longitudinal axis of the subject fluid chamber;

coupling a second target portion of a second sensor assembly to the second plunger along the center longitudinal axis of the subject fluid chamber; and coupling a second sensor portion of the second sensor assembly to the pump body along the center longitudinal axis of the subject fluid chamber.

19. The method of claim 17, further comprising selecting the first plunger and the second plunger to have a ratio of the first outer diameter of the first plunger and the second outer diameter of the second plunger within a range of about 1.10 to about 3.00.

* * * * *